United States Patent [19]

Grosjean

[11] 4,366,199

[45] Dec. 28, 1982

[54] DECORATIVE TEXTILE ELEMENT

[75] Inventor: Pierre Grosjean, Sainte-Foy-les-Lyon, France

[73] Assignee: Rhone-Poulenc-Textile, Paris, France

[21] Appl. No.: 166,395

[22] Filed: Jul. 7, 1980

[30] Foreign Application Priority Data

Jul. 6, 1979 [FR] France ..... 79 19132

[51] Int. Cl.[3] ..... B32B 5/12

[52] U.S. Cl. ..... 428/114; 428/192; 428/292; 428/294; 428/297; 428/375; 428/82

[58] Field of Search ..... 428/88, 89, 192, 292, 428/293, 294, 295, 114, 115, 375, 377, 85, 95, 297, 82; 156/91, 296

[56] References Cited

U.S. PATENT DOCUMENTS

| | | | |
|---|---|---|---|
| 4,048,371 | 9/1977 | Brumlik | 428/375 |
| 4,101,706 | 7/1978 | Wolkowicz | 428/295 |
| 4,143,199 | 3/1979 | Bardon et al. | 428/4 |
| 4,188,429 | 2/1980 | Braconnier et al. | 428/85 |
| 4,211,812 | 7/1980 | Braconnier et al. | 428/257 |
| 4,255,476 | 3/1981 | Joly et al. | 428/82 |

*Primary Examiner*—James J. Bell

*Attorney, Agent, or Firm*—Sherman & Shalloway

[57] ABSTRACT

A decorative textile element consisting of an assembly of parallel textile yarns arranged in bundles and held together at both ends of the bundle. This may be made by assembling at least filiform textile structures in parallel, surrounding the assembly with an envelope, and cutting the resulting product into elements, e.g. using a heated knife.

The elements may be made up into decorative textile articles by threading at least one of the above elements onto a yarn.

9 Claims, 6 Drawing Figures

DECORATIVE TEXTILE ELEMENT

The present invention relates to decorative textile elements and to a method for their manufacture and their applications.

The French Patent Application published under No. 2,318,964 corresponding to U.S. Pat. No. 4,255,476 proposes pile textile elements for decorative use, which consist of an assembly of parallel textile yarns arranged in a bundle and held together in a detachable envelope over at least part of their length, the parallel textile strands of each element being held together at one end of the element while they are free to spread at the other end. For certain applications, such as floor covering, wall covering, artificial flowers and toys, the pile appearance of such elements is desirable.

The above Patent publication also discloses confining the base of the textile element in a means comprising two tubes, and then threading several of the elements, like bobbles, in order to produce decorative objects. However, these objects are heavy because these elements are provided with a collar, in particular if it is desired to produce garlands or curtains, which require a large number of textile elements threaded on textile yarns or wires. The same applies if it is desired to produce the abovementioned objects by threading pile textile elements without a collar, because of the expansion of the piles at the part opposite the contained part, which makes it necessary to thread a large number of textile elements. These expanded pile textile elements have been combined with round wooden, plastic or glass bobbles, beads or plastic elements of various shapes, in order to reduce the weight of the articles of the prior art; nevertheless, the objects produced are no longer entirely textile and they become difficult to wash or dry clean.

According to the present invention there is provided a decorative textile element comprising an assembly of parallel textile yarns arranged in a bundle, the yarns being held together at both ends of the bundle.

Preferably, the textile yarns in the bundle are held together at both ends by welding. This welding can be carried out at the moment of cutting into determined lengths, for example in accordance with the process, and by means of the device, described in the French Patent Application published under No. 2,384,879, corresponding to U.S. Pat. No. 4,201,032 the welding being carried out at the moment of cutting, using a cutting means heated to the appropriate temperature, or after cutting, in line with this process or as a separate operation. The cutting can also be normal cutting and the two ends can subsequently be stuck using a suitable resin, glue or hot melt. The envelope is preferably made of plastic in the form of a film; nevertheless, other means, such as cloths, nonwovens or paper, can be used. A film is preferred because of the possibility of welding it to the contained end of the strands and of strengthening this contained end.

The present invention also provides a method of manufacturing such decorative textile elements, the method comprising assembling at least two filiform textile structures in parallel, surrounding the thus formed assembly with an envelope, cutting the resulting product into elements and heating the cut ends to the melting point of the constituent material of the filiform textile structures.

The term filiform textile structures is understood as meaning texturised or non-texturised continuous yarns, spun fibre yarns, tow and ribbon, used by themselves or in combination.

This gives elements in which the yarns are held together at both ends, or textile bobbles, the length and diameter of which depend on each desired use. As a general rule, the manufacture of the textile bobbles will be adjusted so that they have a length of between 5 and 100 mm, preferably between 10 and 70 mm, and a diameter of between 3 and 30 mm, preferably between 5 and 20 mm. Diameter is understood as meaning the diameter of the held together ends. The bobbles can be straight or deformed, for example crushed by the application of pressure to both ends; they can assume a bulged shape.

The textile materials used are preferably thermoplastic and heat-fusible, such as those based on polyamide, polyester, polyolefine, polyvinyl chloride and the like.

The two ends of the bobbles, or heels, must be strong while at the same time being flexible, non-brittle and easy to pierce. Thus, as indicated in the U.S. Pat. No. 4,255,476, these bobbles can be coloured during their manufacture or afterwards. Of course, it is possible for the coloration of the textile materials constituting the bobbles to have been carried out before the manufacture of the said bobbles.

By threading them onto wire or textile yarn, the bobbles produced in this way can be used for the manufacture of decorative objects, such as toys, necklaces, garlands, curtains, hangings, partitions, door curtains, window dressing, wall decoration, shop window dressing and the like. These objects are obtained by using the textile bobbles by themselves or in combination with other wooden, plastic or glass materials or in combination with the pile textile elements forming the subject of U.S. Pat. No. 4,255,476.

The decorative textile objects thus obtained are lighter than the earlier objects produced from textile elements with expanded piles, they are easy to look after, can be washed or dry cleaned and have a textile appearance which thus makes it possible, by varying the colours, to provide a pleasant decoration for the house, and they are flexible and noiseless, in particular when used as curtains and door curtains. For the house, these textile bobbles make it possible to produce articles which are pleasant to the touch, of warm appearance and comfortable; in this case, these articles are similar to conventional double curtains, curtains and woven or knitted net curtains, while at the same time having a pronounced originality.

In order that the present invention will more readily be understood, the following description is given, merely by way of example, reference being made to the accompanying drawings, in which:

FIG. 1 shows a straight textile bobble according to the present invention consisting of bundles of parallel yarns 2 held together at both their ends 1, the thus formed bobble being shown without an envelope.

FIG. 2 shows a textile bobble formed by exerting a pressure at the two ends 3, of a bobble as shown in FIG. 1, so that the centre portion forms a bulge 4.

Figure 1:
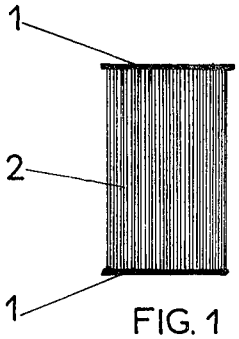
FIGS. 1 and 2 are side elevations of two examples of textile element according to the present invention.
Figure 2:
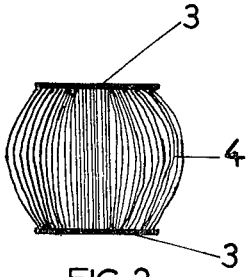
Figure 3:
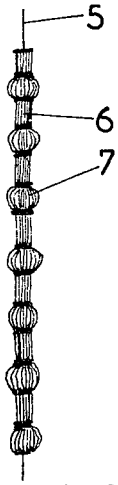
FIGS. 3, 4 and 5 are side elevations of three different arrangements of articles, including elements of the invention, threaded onto a yarn.
Figure 4:
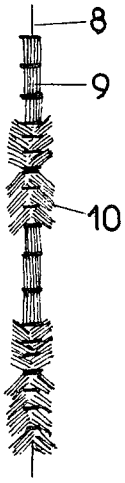
Figure 5:
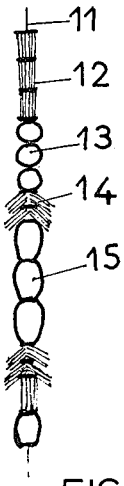

FIGS. 3 to 5 show several decorative embodiments produced by threading, on yarns 5, 8 and 11, bobbles 6, 9 and 12, such as shown in FIG. 1, bobbles 7, such as shown in FIG. 2, pile textile elements 10 and 14 according to the U.S. Pat. No. 4,255,476, wooden bobbles 13 and beads 15.

Figure 6:
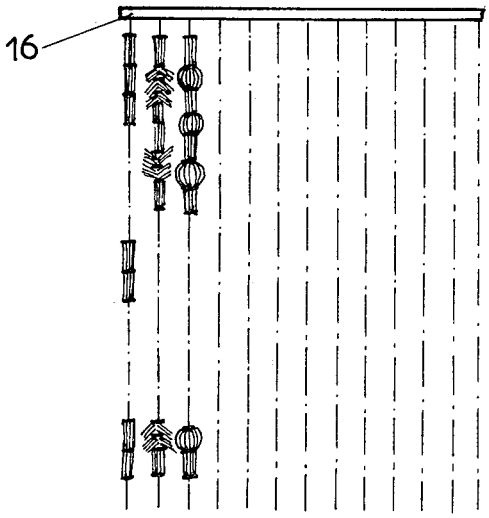
FIG. 6 is a schematic front elevation of a curtain formed using, inter alia textile elements of the invention threaded onto yarns.

FIG. 6 shows a door curtain or curtain 16 produced from bobbles according to the present application, which are used by themselves or in combination with other textile or non-textile elements.

The following examples illustrate the present application without limiting it.

EXAMPLE 1

A bundle is formed from 50 yarns each made up by twisting, at both ends, with a twist of 100 turns/meter in the Z direction, two polyhexamethylene adipamide yarns each having a gauge of 2,800 dtex (2,500 deniers) and comprising 136 strands, each of the latter yarns having a twist of 100 turns/meter in the S direction and these yarns having been texturised beforehand in accordance with the process, and by means of the device, described in French Pat. No. 1,289,491 corresponding to U.S. Pat. No. 3,482,294. To form the bundle and the bobbles of the present application, the device described in U.S. Pat. No. 4,201,032 is used. The envelope consists of a heat-sealable polypropylene film of width 50 mm and thickness 25 microns, the cutting length of the enclosed element is 23 mm and the ends are held together by pressure-welding on a metal plate heated to about 500° C., for 0.5 second.

Textile bobbles having a weight of 0.9 gram, a height of 23 mm and a welding diameter of 13 mm are thus obtained.

EXAMPLE 2

Using the textile bobbles produced in accordance with Example 1, a door curtain having a width of 0.90 meter and a height of two meters is produced, which consists of 15 yarns on which the said bobbles are threaded contiguously; weight of the article after threading: 35 g/meter.

EXAMPLE 3

A door curtain of the same size as in Example 2 is produced by successively threading, on each of the 15 yarns, two textile bobbles and two pile textile elements such as described in U.S. Pat. No. 4,255,476. The threaded article obtained weighs 50 g/meter. The combination of the appearances, bulks and colours makes this arrangement particularly attractive.

EXAMPLE 4

Two pile textile elements, four bobbles and two pile textile elements arranged in the other direction are successively threaded alternately; weight of the article after threading: 55 g/m. Particularly decorative room partitions are produced to a height of two meters, using 12 threaded yarns per meter in the horizontal direction.

EXAMPLE 5

Eight textile bobbles and twenty pile textile elements are successively threaded alternately; weight of the article after threading: 80 g/meter. An article comprising 12 yarns per meter in the horizontal direction is then produced, the designs being staggered and each set of pile textile elements being surrounded by two sets of textile bobbles, and vice versa. By choosing the colours, a wall decoration is thus produced.

EXAMPLE 6

A pressure is exerted on both ends of the textile bobbles obtained in Example 1, using a steam press (or a steam iron); depending on the pressure, this gives bulged bobbles or relatively flattened bobbles resembling large buttons. Mixing by means of threading together with ordinary textile bobbles makes it possible to produce garlands of varied effects.

I claim:

1. A decorative textile article comprising at least one decorative textile element, each element comprising an assembly of parallel textile yarns arranged in a bundle, the ends of the yarns in each bundle being glued or welded together at both ends of the bundle, and an elongate yarn threaded through the glued or welded ends of each of said at least one element.

2. A decorative textile article according to claim 1, wherein the textile yarns are held together at both ends of the bundle by welding.

3. A decorative textile article according to claim 1, wherein the textile yarns are held together at both ends of the bundle by means of an adhesive.

4. A decorative textile article according to claim 1, wherein the bundle of filaments has a surrounding detachable envelope.

5. A decorative textile article according to claim 4, wherein the surrounding detachable envelope is formed from a film of thermoplastic material.

6. A decorative textile article according to claim 1 which comprises a plurality of said decorative textile elements.

7. A decorative textile article according to claim 6 wherein said textile elements have a length of between 10 and 70 mm and a diameter of between 5 and 20 mm.

8. A decorative textile article according to claim 6 wherein at least some of said decorative textile elements have been crushed by the application of pressure to both ends whereby the center portion of said elements between said ends forms a bulged shape.

9. A generally planar decorative article such as a curtain, wall hanging, partition, window dressing and the like comprising a plurality of the decorative textile articles according to claim 6, said decorative textile articles being arranged in parallel to each other.

* * * * *